US005294014A

United States Patent [19]

Wyatt et al.

[11] Patent Number: 5,294,014

[45] Date of Patent: Mar. 15, 1994

[54] CONTAINER CLOSURE ARRANGEMENT

[75] Inventors: W. Burk Wyatt, Brentwood; Gary C. DeGrow, Antioch; Jonathan H. Mueller, Hermitage, all of Tenn.

[73] Assignee: Aladdin Synergetics, Inc., Nashville, Tenn.

[21] Appl. No.: 962,103

[22] Filed: Oct. 16, 1992

[51] Int. Cl.[5] ..... B65D 51/18

[52] U.S. Cl. ..... 220/253; 220/254; 220/336; 220/715; 222/472; 222/484; 222/506; 222/557

[58] Field of Search ..... 220/253, 254, 336, 714, 220/715; 222/506, 510, 556, 557, 470, 472, 478, 482, 484

[56] References Cited

U.S. PATENT DOCUMENTS

| | | | |
|---|---|---|---|
| D. 298,098 | 10/1988 | Craig, III . | |
| 3,416,687 | 12/1968 | Arnaud . | |
| 3,684,123 | 8/1972 | Bridges . | |
| 3,734,360 | 5/1973 | Brown . | |
| 4,054,205 | 10/1977 | Blow, Jr. et al. . | |
| 4,083,467 | 4/1978 | Mullins et al. . | |
| 4,170,724 | 10/1979 | Waterbury . | |
| 4,171,060 | 10/1979 | Howard et al. | 220/254 |
| 4,183,443 | 1/1980 | DeParales et al. . | |
| 4,394,928 | 7/1983 | Philip . | |
| 4,579,245 | 4/1986 | Narushko . | |
| 4,712,704 | 12/1987 | Ramsey et al. | 220/254 |
| 4,795,052 | 1/1989 | Hayes, Jr. . | |
| 5,036,993 | 8/1991 | Ramsey . | |
| 5,072,849 | 12/1991 | Blau . | |
| 5,082,134 | 1/1992 | Ramsey | 220/711 |
| 5,143,248 | 9/1992 | Sawatsky . | |
| 5,148,936 | 9/1992 | DeGrow . | |

OTHER PUBLICATIONS

Automug Advertisement, Pre-Oct. 16, 1992.
Automug Price List, Pre-Oct. 16, 1992.

*Primary Examiner*—Allan N. Shoap
*Assistant Examiner*—Nova Stucker
*Attorney, Agent, or Firm*—Sandler, Greenblum & Bernstein

[57] ABSTRACT

A closure cover for sealing a liquid container including a body having an orifice for dispensing the liquid in the container, and a rotating disk pivotally attached to the body and providing an effective seal for the dispensing orifice. The effective seal is created by a downward force upon a sealing gasket, such force being the result of the rotation of the disk member containing a ramp which is moved under a cam on the body.

38 Claims, 5 Drawing Sheets

CONTAINER CLOSURE ARRANGEMENT

BACKGROUND OF THE INVENTION

The present invention relates to closure covers for liquid containers. More particularly, the invention concerns a simple, inexpensively manufactured closure cover having an opening for dispensing the contents of the container, a vent opening spaced therefrom, and a rotatable disk for closing the respective openings and insuring that the container is properly sealed when said rotatable disk is in a closed position.

Liquid containers for drinking or pouring purposes, that are formed of plastic material, are well known. Commonly, as for example when such containers are intended for use in the retail dispensation of either hot or cold liquids, they are formed with thermally insulated bodies. The bodies may take the form of a double shell construction with the space between the shells containing a heat insulating medium, such as polyurethane foam. Typically, the container at its open, upper end is provided with a closure cover that helps maintain the temperature of the contents of the container as well as to protect against liquid spillage. For liquid dispensing purposes the closure cover is provided with a pair of openings, one of which is particularly suitable for drinking or for pouring the contained liquid. The other opening in the closure cover defines a vent opening for ensuring proper flow from the dispensing opening. A number of different configurations and devices are normally used to seal such openings.

The present invention is directed to the design and construction of a simple, inexpensive combination of a container closure cover with dispensing and venting openings and a disk that rotates to effectively seal the openings, especially when the container is rotated or falls onto its side or is inverted.

SUMMARY OF THE INVENTION

Accordingly, an object of the present invention is to provide a closure cover for a container wherein an effective seal can be attained by the user simply rotating a lever with his or her thumb while holding the handle of the container. Thus, the closure cover can be operated by the same hand used to hold the container.

A further object is to provide a closure cover that, in combination with the container, creates a spill-proof air-tight enclosure, but which can be easily opened with minimal effort by the user.

Accordingly, the present invention provides for a closure device for sealing a container. The closure device comprises a body having an orifice for dispensing liquid or a pourable substance from the container and a rotating disk pivotally attached to the body. The rotating disk has a sealing means for sealing off the dispensing orifice when the closure cover is in the closed position. A pressing means, which is responsive to rotation of the disk, creates a downward force on the sealing means so that the sealing means effectively seals the dispensing orifice.

DETAILED DESCRIPTION OF PREFERRED EMBODIMENTS OF THE INVENTION

Figure 1:
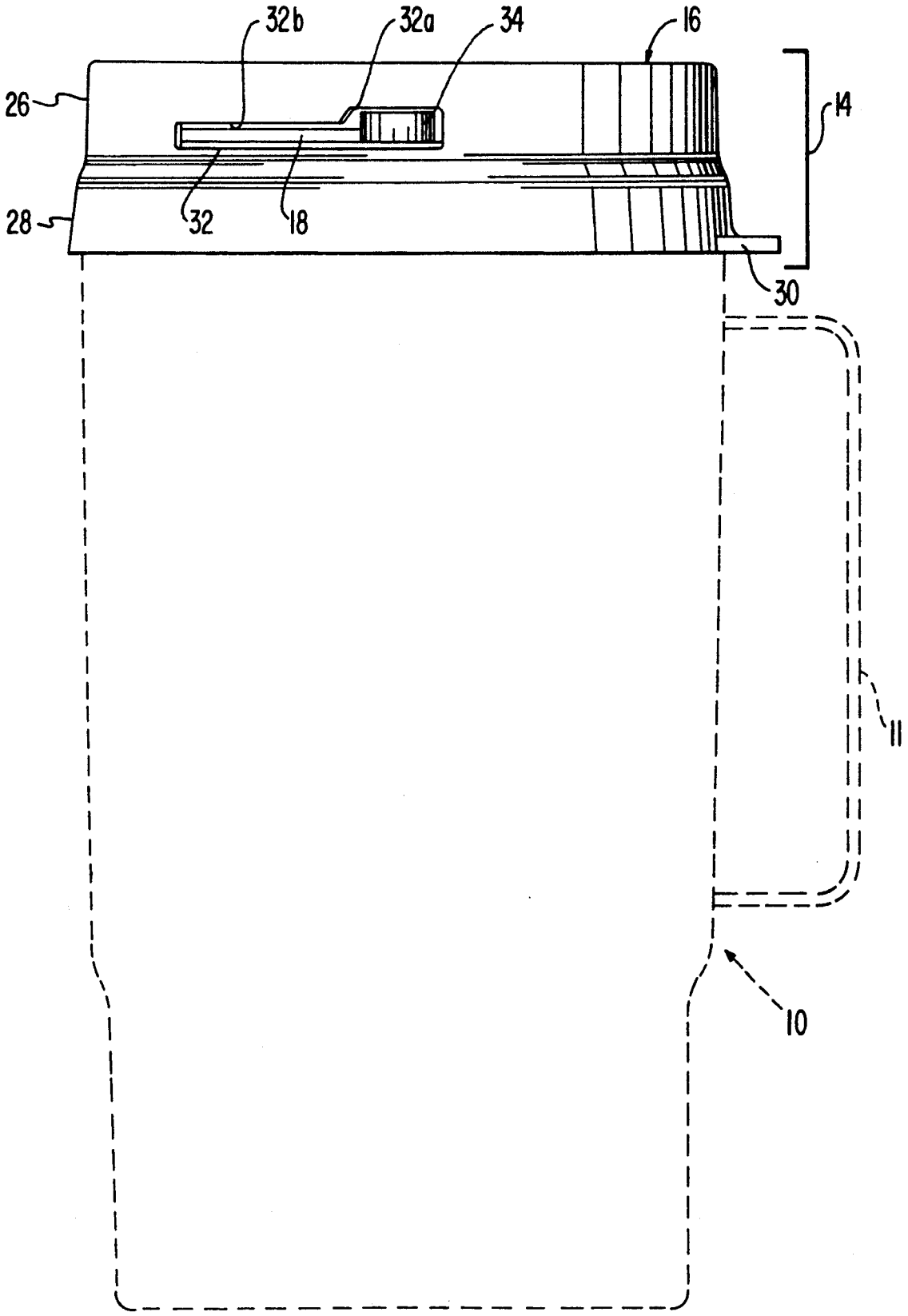
FIG. 1 is a side elevational view of a closure cover of the present invention shown attached to a container.

In FIG. 1 of the drawings there is shown a liquid container, such as large capacity drinking cup 10, formed from plastic material and having heat insulating capabilities. The particular construction of the illustrated cup 10, although not particularly germane to the present invention, can be as shown and described in detail in U.S. Pat. No. 3,684,123, the disclosure of which is incorporated herein by reference.

The upper open end, or mouth, of container 10 is closed by a closure cover arrangement, indicated generally by reference numeral 14, constructed according to the present invention. Closure cover 14 is removably secured to container 10 by means of a flexible snap-on-type sealing connection as hereinafter more fully described. Closure cover 14 may also be secured to container 10 by any other suitable means, such as a screw-on-type arrangement. Closure cover 14 comprises a body portion 15 and a disk member 18, both of which may be formed from any suitable plastic, such as polypropylene copolymer, or any other suitable material. Disk member 18 is rotatably secured to body portion 16 for the selective exposure or closure of dispensing and venting orifices 20 and 22 with which the body portion is provided.

Figure 2:
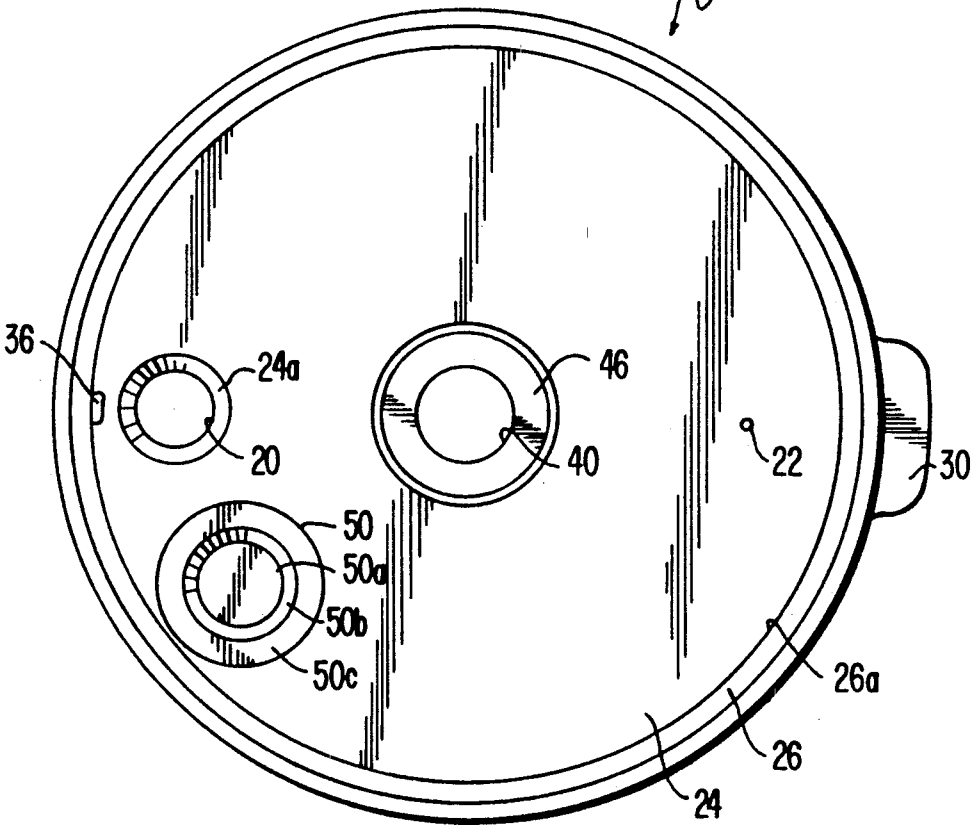
FIG. 2 is a top plan view of the body portion of the closure cover of FIG. 1.
Figure 7:
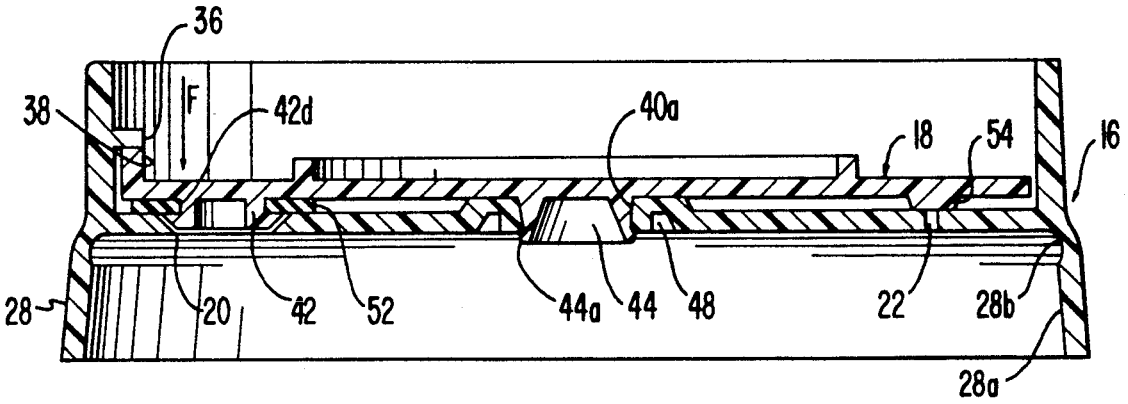
FIG. 7 is a cross-sectional view taken along line 7—7 of FIG. 6 illustrating the closure cover in the closed position.

As best shown in FIGS. 1 and 2, body portion 16 comprises circular base 24, around the outer periphery of which upstanding lip 26 and downward lip 28 extend. Upstanding lip 26 is formed to provide a drinking surface for liquid flowing out of dispensing orifice 20. Upstanding lip 26 has a longitudinal aperture 32 through which operating lever 34 of disk member 18 is disposed. Longitudinal aperture 32 is basically rectangular in shape with enlarged portion **32*a* on one end to allow operating lever 34 to pass through longitudinal aperture 32 during the assembly of body portion 16 and disk member 18 and elongated portion 32*b* which allows actuation of operating lever 34. Also disposed on inner surface 26*a* of upstanding hip 26 is cam 36. Cam 36 is a protrusion located approximately in the center of inner surface 26*a* and above the portion of the periphery of base 24 that is closest to dispensing orifice 20. Cam 36 engages ramp protrusion 38 of disk member 18 during the closing operation to forcibly seal dispensing orifice 20 as will be more fully described hereafter. With reference to FIG. 7, downward lip is formed for securing closure cover 14 onto container 10. Inside surface 28*a* of downward lip 28 is tapered inward toward the center of base 24 and also forms annular recess 28***b*. Annular recess 28*b* is formed to mate with an annular bead (not shown) formed on container 10. The annular bead of container 10 is forced over the tapered surface of inside surface 28*a* to "snap" into a mating arrangement with annular recess 28*b*. Downward lip 28 may be provided with tab 30 to facilitate removal of closure cover 14, as shown in FIG. 1. The user of container can use tab 30 to snap off closure cover 14 by applying an upward force to tab 30.

Base 24 of body portion 16 is, as shown in FIG. 2, provided with three radially aligned through-openings, including dispensing orifice 20, vent orifice 22, and intermediately disposed third opening 40, termed the "axle opening", for reception of a pivot axle on disk member 18, as hereafter explained. Dispensing orifice 20 is formed with a circular configuration. Base 24 has tapered surface 24*a* located on its top surface. Base 24 surrounds dispensing orifice 20 and provides a mating and aligning surface for tapered surface 42*a* of sealing flange 42 of disk member 118.

Vent orifice 22 is formed essentially by a small circular hole that extends through base 24. Axle opening 40 is disposed on the central axis of body portion 16 in radial alignment with the dispensing and vent orifices, 20 and 22 respectively. Opening 40 is adapted to receive axle lug 44 that operates to permit disk member 18 to rotatably move parallel to the plane of body portion 16. Surrounding opening 40 is an annular raised boss 46 that effectively spaces disk member 18 axially from the top surface of body portion base 24 to facilitate movement of the member with respect to the body portion. Annular channel 48 is formed on the bottom surface of base 24 and is concentric with axle opening 40, as shown in FIG. 7.

Figure 9:
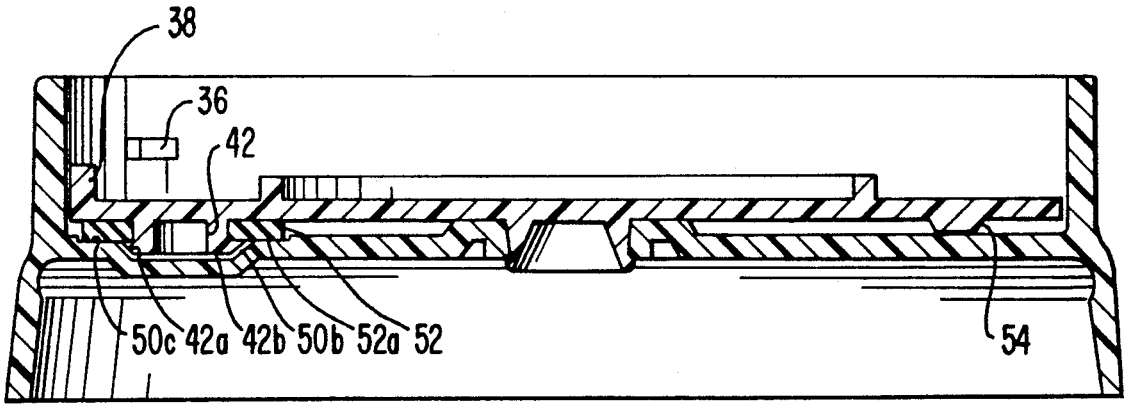
FIG. 9 is a cross-sectional view taken along line 9—9 of FIG. 6 illustrating the closure cover in the open position.

Base 24 also has on its top surface a circular depression 50 which serves as a rest for sealing flange 42 and gasket 52 of disk member 18. Circular depression 50 has bottom planar surface 50*a*, tapered surface 50*b*, and annular planar surface 50*c*. When the closure cover 14 is in its open position, tapered surface 42*a* of sealing flange 42 faces or mates with tapered surface 50*b* and bottom surface 52*a* of gasket 52 mates with annular planar surface 50*c*, as shown in FIG. 9.

Figure 3:
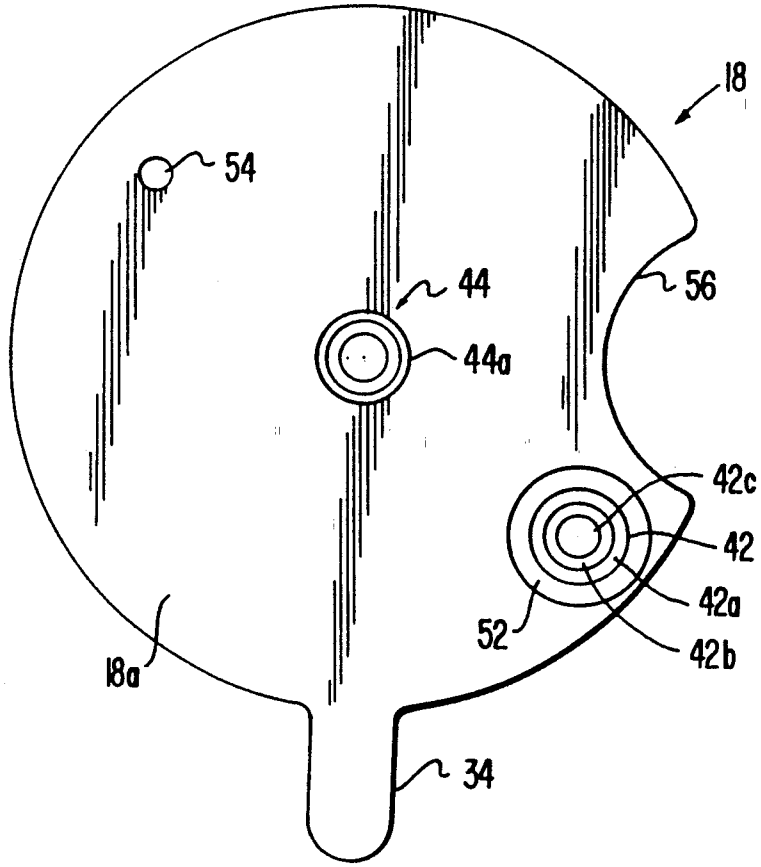
FIG. 3 is a bottom plan view of the disk member of the closure cover of FIG. 1.
Figure 4:
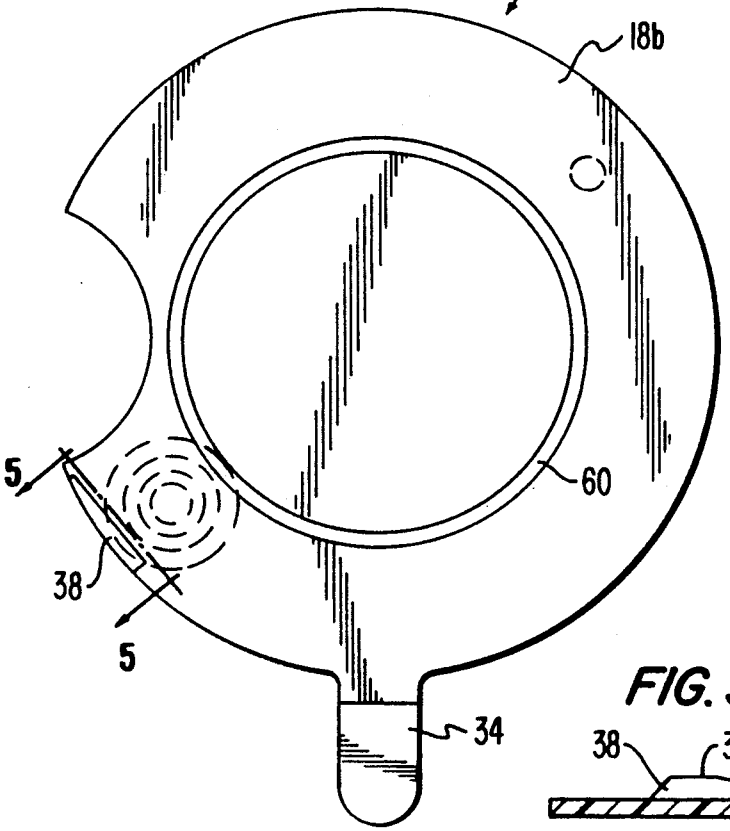
FIG. 4 is a top plan view of the disk member shown in FIG. 3.

Disk member 18, as shown in FIGS. 3 and 4, is provided with sealing flange 42, axle lug 44, and vent sealing protrusion 54 extending from bottom surface 18*a* of disk member 18. Arcuate cutout portion 56 is cut from the perimeter of disk member 18 and operating lever 34 extends from a portion of the perimeter of disk member 18. Annular rib 60 and ramp-shaped protrusion 38 extend from top surface 180*b* of disk member 18.

With further reference to FIG. 7, axle lug 44 is formed as a generally cup-shaped member whose exterior surface about the lower end has a slight annular enlargement or rib 44*a*. Because of this shape, lug 44 has sufficient flexibility to permit it to be radially compressed for insertion into axle opening 40 in the base member. Also, retention of lug 44 in opening 40 is assisted by the fact that opening 40 is formed with a downwardly converging, conical sidewall 40*a*, so that lug 44 can simply be snapped into the opening and disk member 18 securely connected to base portion 24 for rotational movement.

Sealing flange 42 is provided to securely seal dispensing orifice 20 and has tapered surface 42*a*, annular bottom surface 42*b*, circular recess 42*c*, and annular channel 42*d*, as shown in FIG. 7. Gasket 52 is received in annular channel 42*d* and can be formed of any suitable sealing material, such as rubber. Vent sealing protrusion 54 seals off vent orifice 22 and is circular in shape.

Figure 5:
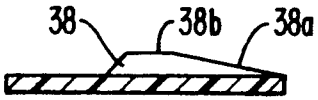
FIG. 5 is a cross-sectional view taken along line 5—5 of FIG. 4.

Arcuate cutout portion 56 allows access to dispensing orifice 20 when closure cover 14 is in its open position. Ramp protrusion 38 is located on the periphery of disk member 18 directly above the portion of the periphery of disk member 18 closest to sealing flange 42. Ramp protrusion 38 has slant surface 38*a* and planar surface 38*b*, as shown in FIG. 5. Ramp protrusion 38 engages cam 36 during the rotation of disk member 18 to effectively close dispensing orifice 20.

Operating lever 34 is actuated by a user of the cup to cause the rotation of disk member I 8. The user, while holding container 10 by handle I 1, can extend his or her thumb of the holding hand upward to move operating lever 34 between the open and closed positions. Thus, the holding of the container and the operating of the closure cover can be accomplished by one hand.

With reference to FIGS. 6, 7, 8, and 9 the operation of closure cover 14 is described below.

Figure 6:
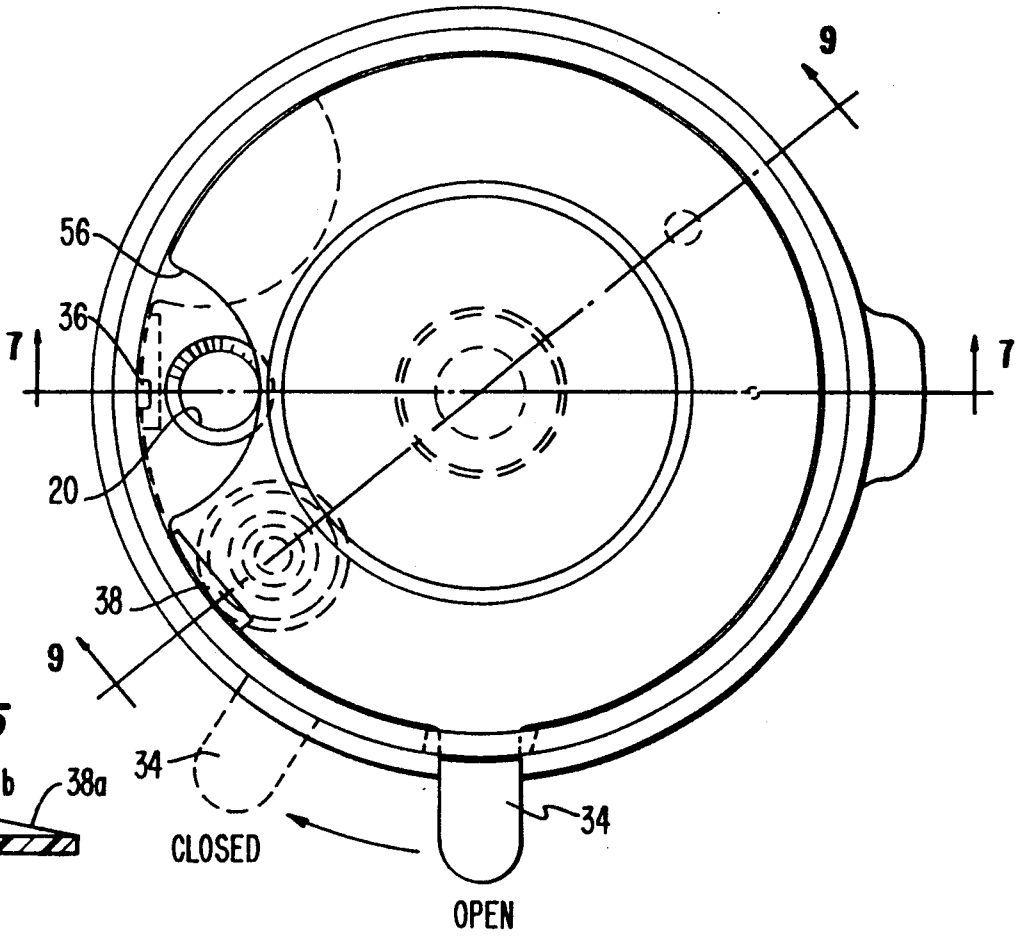
FIG. 6 is a top plan view of the closure cover of FIG. 1 shown in the open position and showing the closed position in dashed lines.
Figure 8:
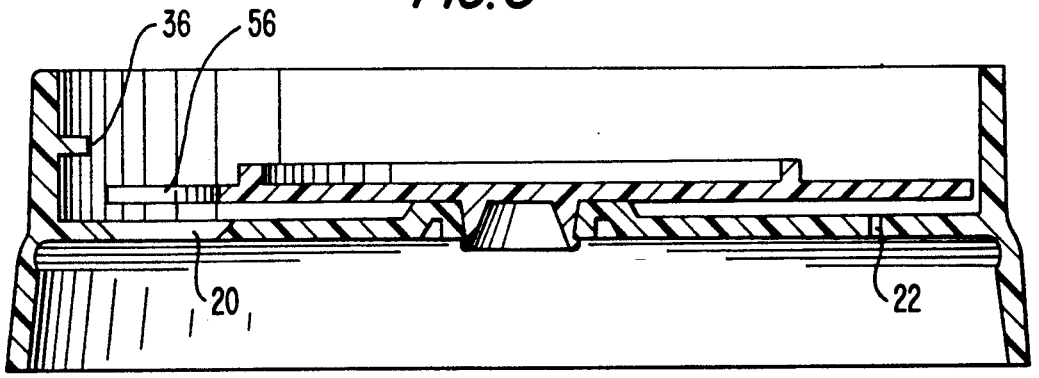
FIG. 8 is a cross-sectional view taken along line 7—7 of FIG. 6 illustrating the closure cover in the open position.

FIGS. 6, 8 and 9 show cover closure 14 in the open position. Dispensing orifice 20 is exposed through arcuate cutout portion 56 so that liquid in container 10 can flow through dispensing orifice 20. Additionally, venting orifice 22 will be open in this position and provide for consistent dispensing of the liquid in container 10. Referring to FIG. 9, the resting arrangement of sealing flange 42 in circular depression 50 is illustrated when the closure cover is in the open position. As illustrated, bottom surface 52*a* of gasket 52 is resting on annular planar surface 50*c* and tapered surface 42*a* of sealing flange 42 is facing or resting on tapered surface 50*b*. Furthermore, vent sealing protrusion 54 is not blocking venting orifice 22, but is disposed in a neutral position on the top surface of base 24.

As operating lever 34 is moved toward the closed position, disk member 18 is rotated and sealing flange 42 is forced out of its resting position in circular depression 50. In an intermediate stage in between the opened and closed positions, bottom annular surface 42*b* of sealing flange 42 slides across the top surface of the portion of base 24 in between circular depression 50 and dispensing orifice 20. As this occurs, disk member 18 is deformed upwardly along its perimeter.

With reference to FIGS. 6 and 7, as operating lever 34 is rotated further towards the closed position, slant surface 38*a* of ramp protrusion 38 begins to engage cam 36 and sealing flange 42 approaches its seating position in dispensing orifice 20. As disk member 19 is rotated and slant surface 26*a* engages cam 36, a gradual downward force is applied to the portion of the perimeter of disk member 18 over sealing flange 42. As planar surface 38*b* of ramp protrusion 38 engages cam 36, sealing flange 42 is seated within dispensing orifice 20. Because of the contact between ramp protrusion 38 and cam 36, a downward force F is exerted along the portion of the perimeter of disk 18 that is above sealing flange 42. Thus, when closure cover 14 is in its closed position (as shown in dashed lines in FIG. 6), sealing flag, 42 and gasket 52 form a very effective seal of dispensing orifice 20. Having gasket 52 under compression insures that a leak-proof air-tight seal is obtained to prevent spills and, further, effectively insulates the container from outside air. Additionally, when closure cover 14 is in its closed position, vent sealing protrusion 54 is positioned directly above venting orifice 22 to effectively seal off orifice 22. Thus, the entire container is effectively sealed, even when it is rotated or falls onto side or when it is completely inverted. Thus, container 10 with closure cover 14 is particularly suited for situations where the container is likely to fall or be knocked over due to external forces, such as when one is driving a car.

In order to reopen the container, a user's thumb actuates the operating lever toward the open position, thus unseating sealing flange 47 from dispensing orifice 20 and moving it into its rest position in circular depression 30.

Thus, this invention allows for easy thumb actuated access to a leak-proof, insulated container. The downward pressure sealing arrangement of the present invention allows the preservation of the temperature inside the container and also makes the container virtually leak-proof even when inverted.

It will be understood that variations and changes in the details, materials, an arrangement of the parts, which have been herein described and illustrated in order to explain the nature of the invention, may be made by those skilled in the art within the principles and scope of the invention. What is sought to be protected herein is as recited in the appended claims.

We claim:

1. A closure device for sealing a container, comprising:

a body having a dispensing orifice;

a rotating member pivotally attached to said body and having sealing means for sealing said orifice such that said orifice is in a closed condition, said rotating member allowing flow through said dispensing orifice when said orifice is in an open condition; and pressing means responsive to the rotation of said rotating member for pressing said sealing means at said orifice to ensure proper seal of said orifice, said pressing means applying a downward force to a top surface of said rotating member along a portion of a perimeter of said rotating member that is adjacent said dispensing orifice.

2. The closure device of claim 1 wherein said sealing means includes a gasket.

3. The closure device of claim 1 wherein said pressing means includes a cam and a ramp, said ramp engaging said cam to press said sealing means into said orifice when said orifice is in the closed condition.

4. The closure device of claim 3 wherein said cam is attached to said body and said ramp is attached to said rotating member.

5. The closure device of claim 1 wherein said rotating member is a disk that is circular in shape.

6. The closure device of claim 1 wherein said body has a venting orifice.

7. The closure device of claim 6 wherein said rotating member has a sealing protrusion for sealing said venting orifice in response to the rotation of said rotating member.

8. The closure device of claim 1 further comprising a lever attached to said rotating member for rotating said member.

9. The closure device of claim 8 wherein said lever is actuatable by the thumb of the user's hand which is grasping the container.

10. The closure device of claim 1 wherein said rotating member has a cutout position disposed along its periphery, and when said orifice is in the open condition said cutout portion is disposed directly over said dispensing orifice and thereby allows direct access to said dispensing orifice.

11. The closure device of claim 8 wherein said body has an upstanding lip with a longitudinal aperture disposed therein, said lever extending through said aperture.

12. The closure device of claim 1 wherein said body has a top surface, said top surface has a depression, and said sealing means extends into said depression when said orifice is in the open condition.

13. The closure device of claim 1 wherein said pressing means presses said sealing means into said orifice.

14. A closure device for sealing a container, comprising:

a body having a dispensing orifice;

a rotating member pivotally attached to said body and having sealing means for sealing said orifice such that said orifice is in a closed condition, said rotating member allowing flow through said dispensing orifice when said orifice is in an open condition;

a ramp attached to said rotating member, said ramp having a planar surface and an inclined surface, said inclined surface is inclined relative to and is adjacent to said planar surface; and a cam attached to said body, said cam riding along said inclined surface when said rotating member is rotated to apply a downward force to said rotating member to seal said orifice, said cam resting on said planar surface when said orifice is in the closed condition.

15. The closure device of claim 14 wherein said rotating member has a cutout portion disposed along its periphery, and when said orifice is in the open condition, said cutout portion is disposed directly over said dispensing orifice and thereby allows direct access to said dispensing orifice.

16. The closure device of claim 14 further comprising a lever attached to said rotating member for rotating said member, said body having an upstanding lip with a longitudinal aperture disposed therein, and said lever extending through said aperture.

17. The closure device of claim 14 wherein said body has a top surface, said top surface having a depression, and said sealing means extends into said depression when said orifice is in the open condition.

18. A closure device for sealing a container, comprising:

a body having a dispensing orifice;

a rotating member pivotally attached to said body and having sealing means for sealing said orifice such that said orifice is in a closed condition, said rotating member allowing flow through said dispensing orifice when said orifice is in an open condition;

a ramp attached to said rotating member, said ramp being positioned on and extending upwards from a top surface of said rotating member; and a cam attached to said body and extending inward from the perimeter of said body, wherein said ramp engages said cam and thereby presses said sealing means into said orifice when said orifice is in the closed condition.

19. The closure device of claim 18 wherein said rotating member has a cutout portion disposed along its periphery, and when said orifice is in the open condition, said cutout portion is disposed directly over said dispensing orifice and thereby allows direct access to said dispensing orifice.

20. The closure device of claim 18 further comprising a lever attached to said rotating member for rotating said member, said body having an upstanding lip with a longitudinal aperture disposed therein, and said lever extending through said aperture.

21. The closure device of claim 14 wherein said body has a top surface, said top surface having a depression, and said sealing means extends into said depression when said orifice is in the open condition.

22. A closure device for sealing a container, comprising:

a body having a dispensing orifice;

a rotating member pivotally attached to said body;

a flange attached to and extending downward from said rotating member, said flange having a lower surface that protrudes into said orifice when said orifice is in a closed condition, said flange having an annular channel disposed on a side surface of said flange;

a gasket disposed in said channel and extending around said flange, said gasket engaging a top surface of said body adjacent said dispensing orifice when said orifice is in the closed condition such that said dispensing orifice is properly sealed; and said rotating member having a cutout portion disposed along its periphery, and when said orifice is in an open condition, said cutout portion is disposed directly over said dispensing orifice and thereby allows direct access to said dispensing orifice.

23. The closure device of claim 22 wherein said body has a venting orifice spaced from said dispensing orifice.

24. The closure device of claim 23 wherein said rotating member has a sealing protrusion for sealing said venting orifice when said dispensing orifice is in the closed condition.

25. The closure device of claim 22 further comprising a lever attached to said rotating member for rotating said member.

26. The closure device of claim 25 wherein said lever is actuatable by the thumb of a user's hand which is grasping the container.

27. The closure device of claim 25 wherein said body has an upstanding lip with a longitudinal aperture disposed therein, said lever extending through said aperture.

28. The closure device of claim 22 wherein said rotating member is a circular disk.

29. The closure device of claim 27 wherein said top surface of said body has a depression, said lower surface of said flange extending into said depression when said orifice is in the open condition.

30. A closure device for sealing a container, comprising:

a body having a dispensing orifice, an upstanding lip with a longitudinal aperture disposed therein, and a body top surface;

a rotating member pivotally attached to said body;

a flange attached to and extending downward from said rotating member, said flange having a lower surface that protrudes into said orifice when said orifice is in a closed condition, said flange having an annular channel disposed on a side surface of said flange;

a gasket disposed in said channel and extending around said flange, said gasket engaging said body top surface adjacent said dispensing orifice when said orifice is in the closed condition such that said dispensing orifice is properly sealed; and a lever attached to said rotating member for rotating said member, said lever extending through said aperture.

31. The closure device of claim 30 wherein said top surface of said body has a depression, said lower surface of said flange extending into said depression when said orifice is in an open condition.

32. The closure device of claim 30 wherein said rotating member has a cutout portion disposed along its periphery, and when said orifice is in an open condition, said cutout portion is disposed directly over said dispensing orifice and thereby allows direct access to said dispensing orifice.

33. The closure device of claim 30 wherein said aperture is generally rectangular in shape and has an enlarged portion at one end thereof.

34. A closure device for sealing a container, comprising:

a body having a dispensing orifice and a body top surface, said body top surface having a depression;

a rotating member pivotally attached to said body;

a flange attached to and extending downward from said rotating member, said flange having a lower surface that protrudes into said orifice when said orifice is in a closed condition, said flange having an annular channel disposed on a side surface of said flange, said lower surface of said flange extending into said depression when said orifice is in an open condition; and a gasket disposed in said channel and extending around said flange, said gasket engaging said body top surface adjacent said dispensing orifice when said orifice is in the closed condition such that the dispensing orifice is properly sealed.

35. The closure device of claim 34 wherein said rotating member has a cutout portion disposed along its periphery, and when said orifice is in the open condition, said cutout portion is disposed directly over said dispensing orifice and thereby allows direct access to said dispensing orifice.

36. The closure device of claim 34 further comprising a lever attached to said rotating member for rotating said member, said body having an upstanding lip with a longitudinal aperture disposed therein, and said lever extending out through said aperture so as to be accessible to a user.

37. The closure device of claim 34 wherein said depression is circular in shape.

38. The closure device of claim 34 wherein said depression has an annular planar surface positioned below said top surface of said body and a bottom planar surface positioned below said annular planar surface.

* * * * *

UNITED STATES PATENT AND TRADEMARK OFFICE

CERTIFICATE OF CORRECTION

PATENT NO. : 5,294,014

DATED : March 15, 1994

INVENTOR(S) : W. Burk WYATT et al.

It is certified that error appears in the above-indentified patent and that said Letters Patent is hereby corrected as shown below:

column 2, line 59, change "hip" to ---lip---.

column 2, line 67, change "lip" to ---lip 28 ---.

column 3, line 9, change "container" to ---container 10---.

column 3, line 21, change "118" to ---18---.

column 3, line 53, change "118" to ---18---.

column 4, line 15, change "I8" to ---18---.

column 4, line 61, change "flag," to ---flange---.

column 5, line 19, change "an" to ---and---.

column 5, line 37 (claim 1, line 12), change "ensure proper" to ---ensure a proper---.

UNITED STATES PATENT AND TRADEMARK OFFICE

CERTIFICATE OF CORRECTION

PATENT NO. : 5,294,014
DATED : March 15, 1994
INVENTOR(S) : W. Burk WYATT et al.

It is certified that error appears in the above-indentified patent and that said Letters Patent is hereby corrected as shown below:

column 5, line 66 (claim 10, line 2), change "position" to ---portion---.

column 7, line 8 (claim 21, line 1), change "14" to ---18---.

Signed and Sealed this

Twenty-sixth Day of November 1996

*Attest:*

*Attesting Officer*

Bruce Lehman

BRUCE LEHMAN

*Commissioner of Patents and Trademarks*